US007100850B2

(12) United States Patent
Farmerie

(10) Patent No.: US 7,100,850 B2
(45) Date of Patent: Sep. 5, 2006

(54) FOOD WASTE DISPOSER HAVING MECHANISM AND METHOD FOR CREATING A WATER BAFFLE TO REDUCE NOISE

(75) Inventor: Joseph G. Farmerie, Muskego, WI (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/997,678

(22) Filed: Nov. 29, 2001

(65) Prior Publication Data

US 2002/0063179 A1 May 30, 2002

Related U.S. Application Data

(60) Provisional application No. 60/253,804, filed on Nov. 29, 2000.

(51) Int. Cl.
*B02C 18/42* (2006.01)

(52) U.S. Cl. ..... 241/21; 241/46.014; 241/46.016

(58) Field of Classification Search ..... 241/46.012–46.016, 241/241/21
See application file for complete search history.

(56) References Cited

U.S. PATENT DOCUMENTS 2,784,915 A * 3/1957 Gordon ..... 241/46.013
2,834,554 A * 5/1958 Bebinger
3,025,007 A 3/1962 Wieczorek ..... 241/100.5
5,308,000 A * 5/1994 Riley ..... 241/33
5,676,319 A * 10/1997 Stiggins et al. ..... 241/46.012

OTHER PUBLICATIONS

Marketing Brochure for Japanese Waste Disposal Unit manufactured by Toto, Ltd. of Japan; Feb., 1999.
U.S. patent application Ser. No. 10/066,893, entitled "A Baffle for a Food Waste Disposer to Reduce Noise and Associated Methods"; Filed Feb. 4, 2002.

* cited by examiner

*Primary Examiner*—Mark Rosenbaum
(74) *Attorney, Agent, or Firm*—Locke Liddell & Sapp LLP

(57) ABSTRACT

The present invention provides a food waste disposer having an upper food conveying section, a motor section, a central grinding section and an inlet portion. The upper food conveying section includes a housing to receive food waste. The motor section includes a motor to impart rotational movement to a motor shaft. The central grinding section is disposed between the food conveying section and the motor section, the food conveying section conveys food waste to the grinding section. The inlet portion has a water injection inlet capable of forming a water baffle in the inlet portion. The water baffle is present when the motor is running. The inlet portion may be integrally formed as part of the housing of the food conveying section or may be a separate unit. The water baffle may extend substantially across the inlet portion in a generally horizontal plane. The present invention further includes a method of reducing noise in a food waste disposer by creating a water baffle in an inlet portion of the food waste disposer.

27 Claims, 9 Drawing Sheets

FOOD WASTE DISPOSER HAVING MECHANISM AND METHOD FOR CREATING A WATER BAFFLE TO REDUCE NOISE

The present application claims priority from Provisional Application Ser. No. 60/253,804 entitled "Food Waste Disposer Having Mechanism And Method For Creating A Water Baffle To Reduce Noise" filed Nov. 29, 2000, which is commonly owned and incorporated herein by reference in its entirety.

FIELD OF THE INVENTION

The present invention relates generally to food waste disposers and, more particularly, to a food waste disposer having a mechanism for creating a water baffle and methods to reduce noise.

BACKGROUND OF THE INVENTION

Conventional food waste disposers produce noise during operation. FIGS. 1 and 2 depict a typical food waste disposer 10. The disposer 10 includes an upper food conveying section 12, a lower motor section 14, and a central grinding section 16 disposed between the food conveying section 12 and the motor section 14. The food conveying section 12 includes a housing 18 that forms an inlet 20 at its upper end for receiving food waste. The disposer 10 also has a dishwasher inlet 19 to receive wastewater from a disposer. Wastewater is injected into the grinding section 16 during various cycles of the dishwasher and is independent of the operation of the disposer.

The food conveying section 12 conveys the food waste to the central grinding section 16. The motor section 14 includes an induction motor 22 imparting rotational movement to a motor shaft 24. The motor 22 is enclosed within a motor housing 26. The grinding section 16 includes a grinding mechanism having a circular plate 34, a pair of lugs 36, and a stationary shredder ring 38. The plate 34 is mounted to the motor shaft 24 of the motor section 14. The lugs 36 are fastened to the plate 34 but are free to rotate relative to the rotating plate 34. The shredder ring 38 has a plurality of teeth 40.

The inlet 20 of the housing 18 is attached to a drain opening 42 of a sink 44 by a connecting apparatus 46. Although different mechanisms exist, one type of connecting apparatus is disclosed in U.S. Pat. No. 3,025,007.

In the operation of the food waste disposer 10, the food waste is passed through the drain opening 42, through the food conveying section 12, and to the grinding section 16. The food waste delivered to the grinding section 12 is forced by lugs 36 on the rotating plate 34 against teeth 40 of the shredder ring 38. The edges of the teeth 40 grind or comminute the food waste into particular matter sufficiently small to pass from above the grinding plate 34 to below the grinding plate 34 via gaps between the teeth 40 outside the periphery of the plate 34. Due to gravity, the particulate matter passes through the gaps between the teeth 40 drops onto an upper end frame 48 and, along with water injected into the disposer 10 via the drain opening 42, is discharged through a discharge outlet 50 into a tailpipe 52.

A significant amount of external noise may be generated by conventional disposers. This is due, in part, by the operation of the induction motor as well as the rotation and movement of the metal plate and swivel lugs. Noise is also generated by food particles that are forced against the shredder ring by the rotating plate and lugs. To reduce noise, it has been known to place an insulating cover around the exterior housings of conventional disposers. An exterior cover, however, does not prevent noise from dissipating up through the drain opening. Accordingly, there is a need to reduce the amount of noise generated through the drain opening.

The present invention is directed to overcoming, or at least reducing the effects of, one or more of the problems set forth above.

SUMMARY OF THE INVENTION

To that end, the present invention provides a food waste disposer having an upper food conveying section, a motor section, a central grinding section and an inlet portion. The upper food conveying section includes a housing to receive food waste. The motor section includes a motor to impart rotational movement to a motor shaft. The central grinding section is disposed between the food conveying section and the motor section, the food conveying section conveys food waste to the grinding section. The inlet portion has a water injection inlet capable of forming a water baffle in the inlet portion when water is supplied by a pressured water source. The water baffle is used when the motor is running.

The inlet portion may be integrally formed as part of the housing of the food conveying section or may be a separate unit. The water baffle extends substantially across the inlet portion in a generally horizontal plane. The food waste disposer may further include a water valve connected between the water injection inlet and a pressurized water source. The water valve may be controlled by a solenoid or actuator.

The present invention also includes a food waste disposer including a tubular food waste inlet portion, a motor section, a central grinding section, and a water injection inlet. The motor section includes a motor to impart rotational movement to a motor shaft. The central grinding section is generally disposed between the tubular food waste inlet portion and the motor section. The tubular food waste inlet portion helps convey food waste to the grinding section. The grinding section includes a grinding plate. The water injection inlet is attached to the tubular food waste inlet portion. The water injection inlet is in fluid communication with a water source when the motor imparts rotational movement to the motor shaft to form a water baffle in the tubular food waste inlet portion.

The present invention further includes a method of reducing noise in a food waste disposer. The food waste disposer has a motor section, a grinding section and an inlet portion. The inlet portion has a water injection inlet. The method comprises the steps of: activating a motor in the motor section to provide rotational movement to a grinding mechanism in the grinding section; and injecting water through the water injection inlet to create a water baffle inside the inlet portion. The water baffle in the method is used to reduce the noise and may extend substantially across the inlet portion in a generally horizontal plane.

The above summary of the present invention is not intended to represent each embodiment, or every aspect of the present invention. This is the purpose of the figures and detailed description which follow.

BRIEF DESCRIPTION OF THE DRAWINGS

Other objects and advantages of the invention will become apparent upon reading the following detailed description and upon reference to the drawings.

Figure 1:
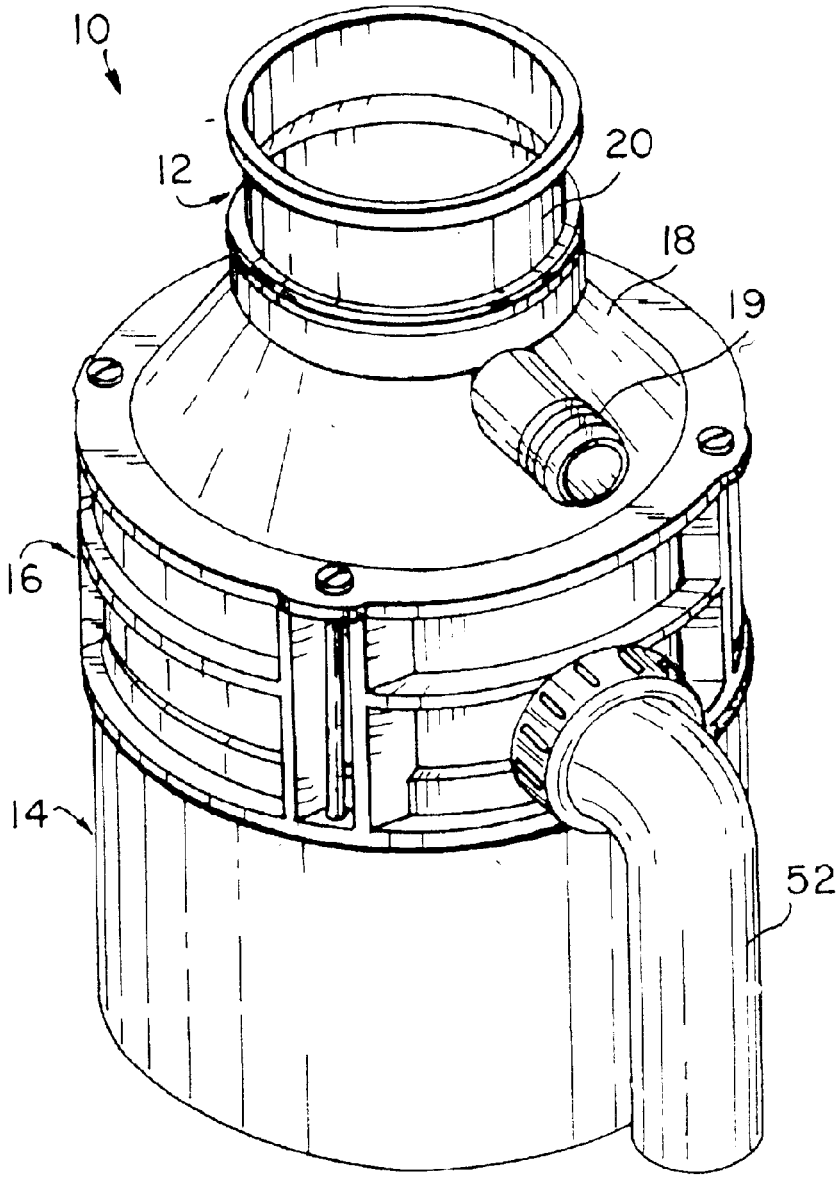
FIG. 1 (PRIOR ART)
FIG. 1 is a perspective view of a conventional food waste disposer.
Figure 2:
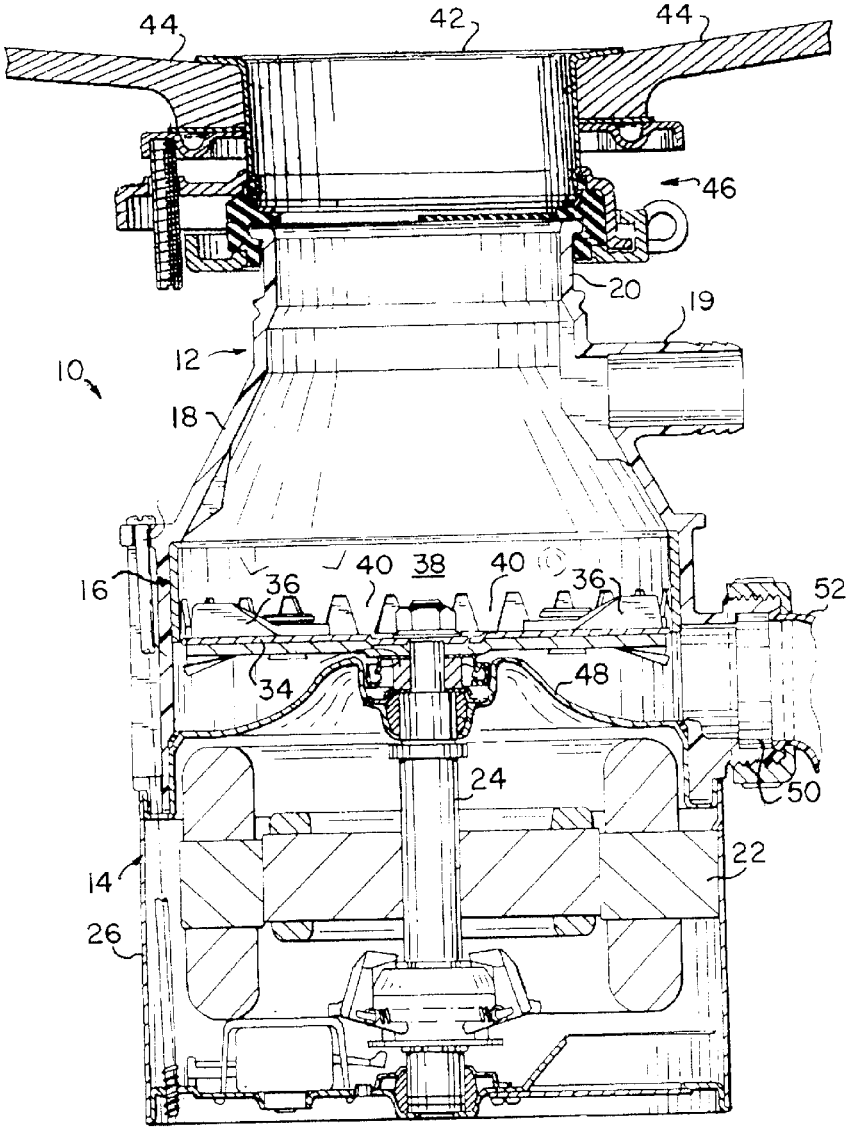
FIG. 2 (PRIOR ART)
FIG. 2 is a cross-sectional view of a conventional food waste disposer attached to a sink and drain opening.

While the invention is susceptible to various modifications and alternative forms, certain specific embodiments thereof have been shown by way of example in the drawings and will be described in detail. It should be understood, however, that the intention is not to limit the invention to the particular forms described. On the contrary, the intention is to cover all modifications, equivalents, and alternatives falling within the spirit and scope of the invention as defined by the appended claims.

DESCRIPTION OF PREFERRED EMBODIMENTS

Figure 3:
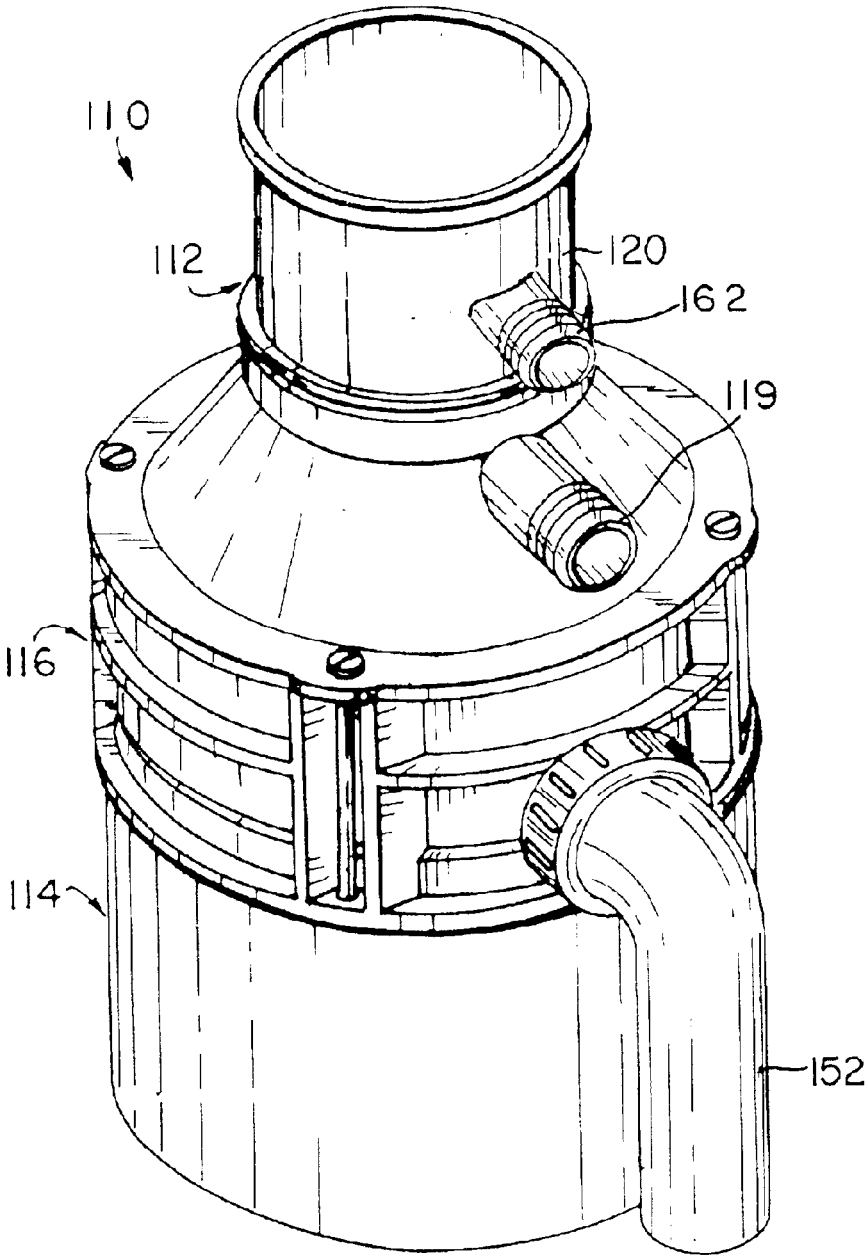
FIG. 3 is a perspective view of one embodiment of a food waste disposer of the present invention.
Figure 4:
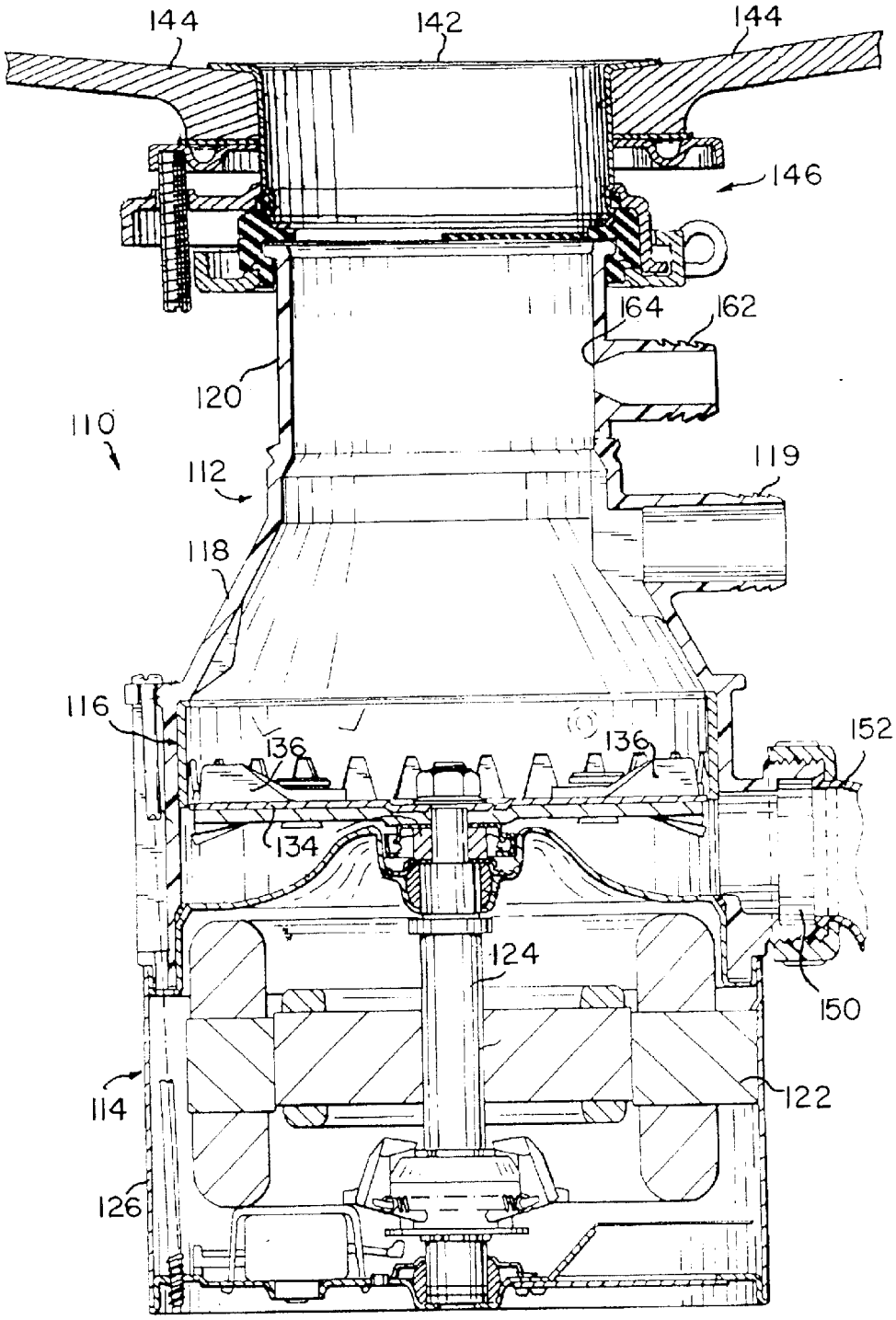
FIG. 4 is a cross-sectional view of the food waste disposer in FIG. 3 attached to a sink and drain opening.

Turning to the drawings, FIG. 3 depicts a food waste disposer 110 embodying the present invention. The disposer 110 includes an upper food conveying section 112, a lower motor section 114, and a central grinding section 116 disposed between the food conveying section 112 and the motor section 114. In one embodiment, as shown in FIG. 4, the food conveying section 112 includes a housing 118 that forms an inlet portion 120 at its upper end for receiving food waste. On the side of the inlet portion 120 is a water injection inlet 162. As described in more detail below, the water injection inlet 162 is used to create a water baffle inside the inlet portion 120.

The housing 118 also has a dishwasher inlet 119. The dishwasher inlet 119 is used to pass wastewater from a dishwasher (not shown). Although the dishwasher inlet 119 allows wastewater to pass into the central grinding section 116, the passage of water through the inlet 119 is independent of the operation of the disposer 110.

The food conveying section 112 conveys the food waste to the central grinding section 116. The motor section 114 includes a motor 122 imparting rotational movement to a motor shaft 124. The motor 122 is enclosed within a motor housing 126. The motor 122 is activated when a user turns on a switch.

The grinding section 116 includes a grinding mechanism having a circular plate 134, a pair of lugs 136, and a stationary shredder ring 138. The plate 134 is mounted to the motor shaft 124 of the motor section 114. In one embodiment, the lugs 136 are fastened to the plate 134 but are free to rotate relative to the rotating plate 134. The shredder ring 138, which includes a plurality of spaced teeth 140, may be fixedly attached to an inner surface of the housing 118 by an interference fit and is preferably composed of stainless steel but may be made of other metallic material such as galvanized steel. Although the disposer 110 is shown as having lugs 126 that are swivel-type, the disposer 110 could also include a grinding section 116 having fixed lugs.

The inlet portion 120 of the disposer 110 is attached to a drain opening 142 of a sink 144 by a connecting mechanism 146. A variety of connecting mechanisms currently exist. One type of mechanism is disclosed in U.S. Pat. No. 3,025,007, which is owned by the assignee of the present invention and incorporated herein by reference.

In the operation of the food waste disposer 110, the food waste is passed through the drain opening 142, through the inlet portion 120, and to the grinding section 116. The food waste delivered to the grinding section 112 is forced by lugs 136 on the rotating plate 134 against teeth 140 of the shredder ring 138. The edges of the teeth 140 grind or comminute the food waste into particular matter sufficiently small to pass from above the grinding plate 134 to below the grinding plate 134 via gaps between the teeth 140 outside the periphery of the plate 134. Due to gravity, the particulate matter passes through the gaps between the teeth 140 drops onto an upper end frame 148 and, along with water injected into the disposer 110 via the drain opening 142, is discharged through a discharge outlet 150 into a tailpipe 152.

Figure 5:
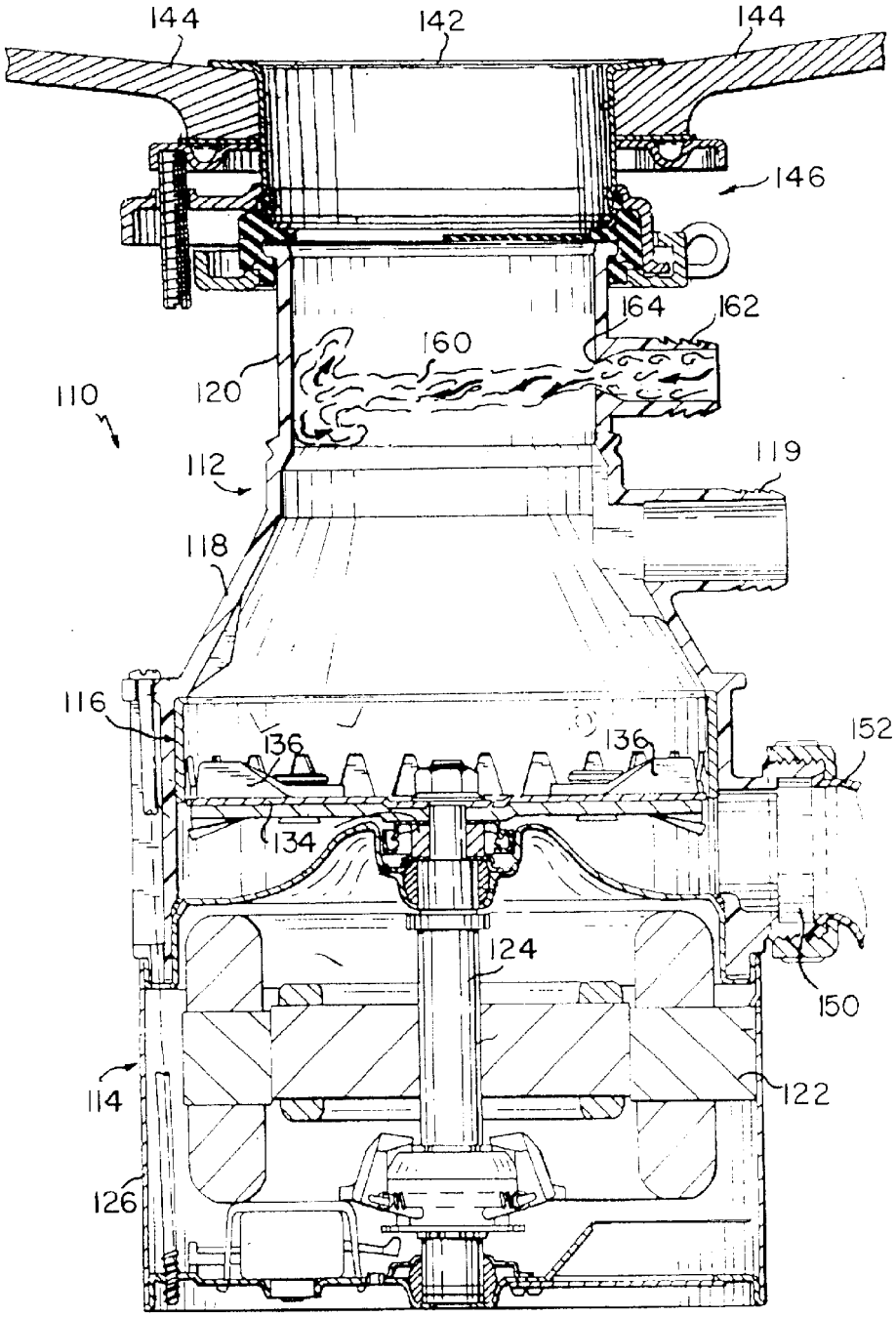
FIG. 5 is a cross-sectional view of the food waste disposer in FIG. 4 during operation.

Referring to FIG. 5, it has been found, through the present invention, that creating a water baffle 160 inside the inlet portion 120 of the disposer 110 reduces the amount of noise through the drain opening 142. In one embodiment, to create the water baffle 160, the inlet portion 120 includes a water injection inlet 162 having a nozzle 164. During the operation of the disposer 110, water is automatically injected into the inlet portion 120 via the nozzle 164 of the water injection inlet 162. The nozzle 164 spreads the incoming water across the inlet portion 120 and creates a water baffle that extends substantially across the inlet portion 120 in a generally horizontal plane.

Figure 6:
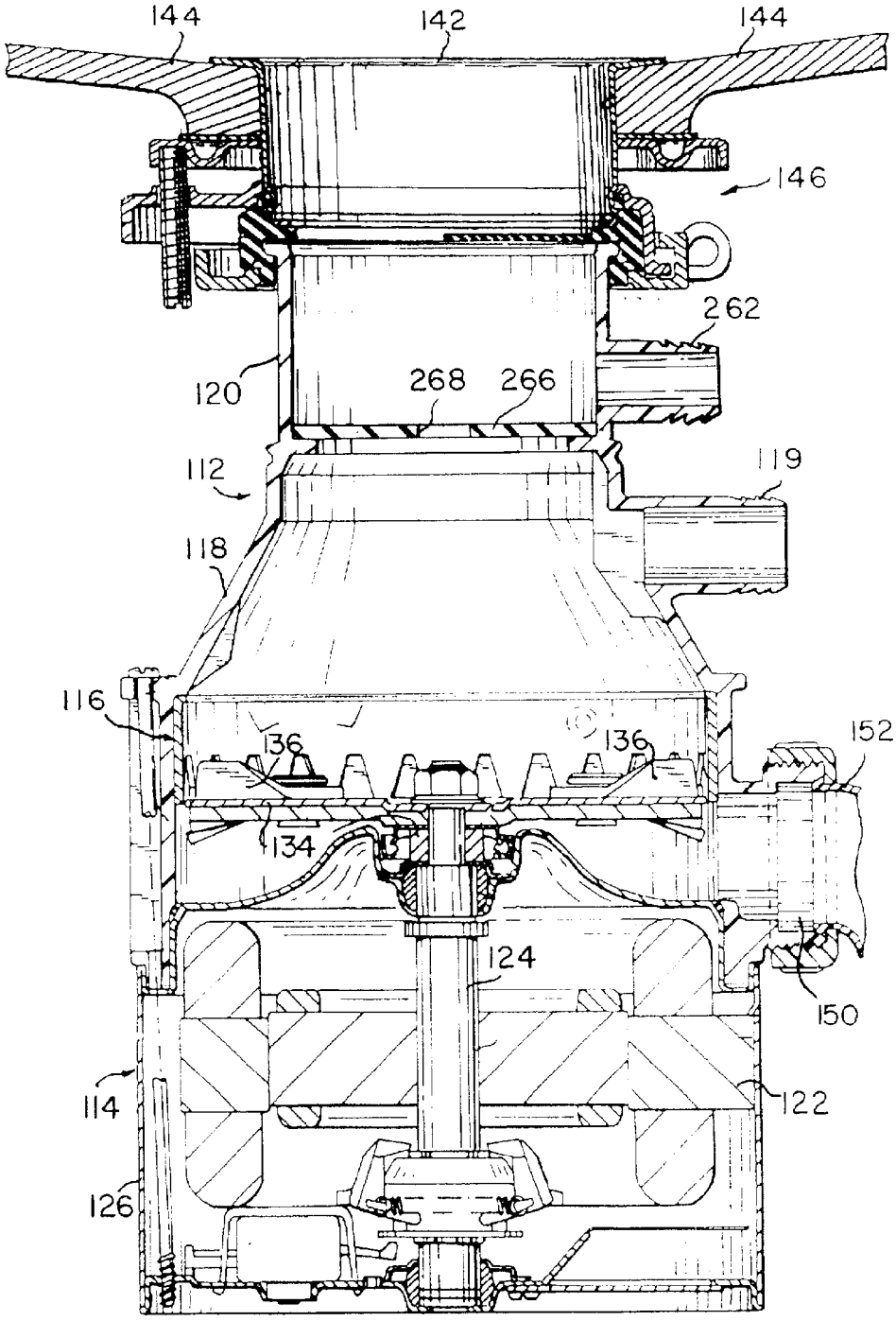
FIG. 6 is a cross-sectional view of another embodiment of a food waste disposer of the present invention.
Figure 7:
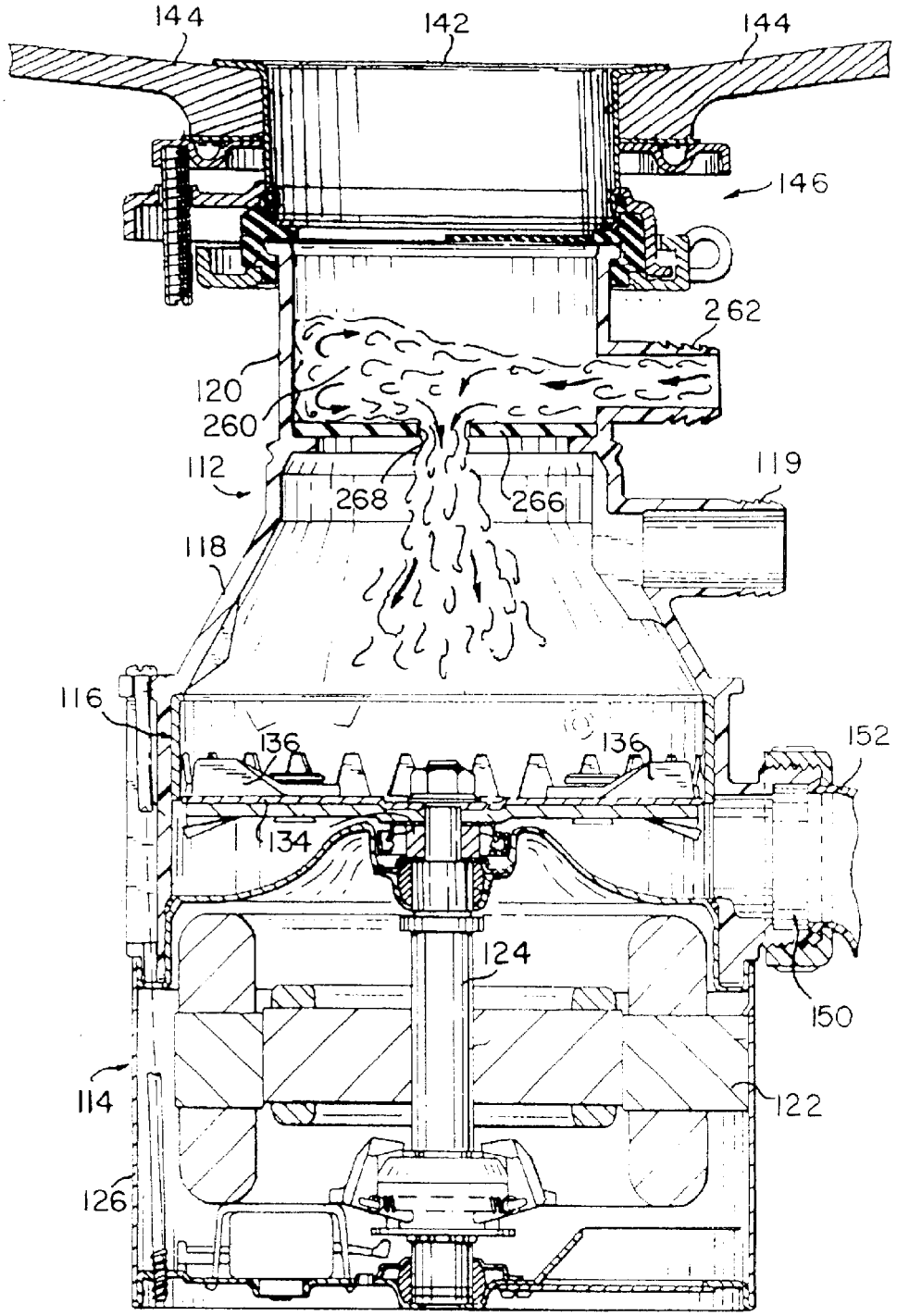
FIG. 7 is a cross-sectional view of the food waste disposer in FIG. 6 during operation.
Figure 8:
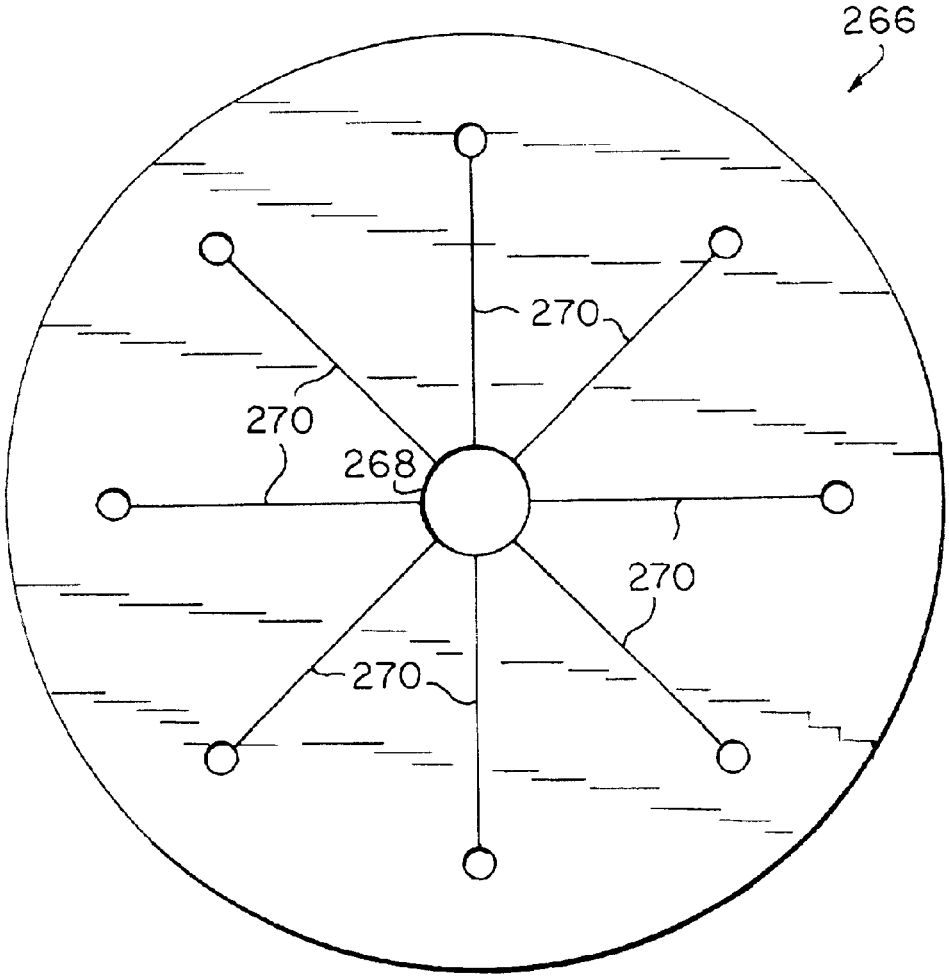
FIG. 8 is a top view of a secondary baffle used in the food waste disposer in FIG. 6.

In another embodiment, referring to FIGS. 6 and 7, a water baffle 260 is created by using a secondary baffle 266. The secondary baffle 266 is located at a lower portion of the inlet portion 120 and below a water injection inlet 262. In this embodiment, a nozzle is not needed as part of the water injection inlet 262. Water is injected into the inlet portion 120 through the water injection inlet 262. As the water is injected into the inlet portion 120, the secondary baffle 266 sustains a portion of the water to create the water baffle 260 that extends substantially across the inlet portion 120 in a generally horizontal plane. The secondary baffle 266 is preferably made of rubber or other flexible material. As shown in FIG. 8, the secondary baffle 266 has an interior hole 268 to allow water to pass through the secondary baffle 266. The diameter of the interior hole 268 is preferably smaller than the diameter of the water injection inlet 260. The secondary baffle 266 also has slots 270 to allow food waste to pass through the secondary baffle 266. In addition to the water baffle 260, the flexible secondary baffle 266 creates an additional layer for reducing noise created by the motor 122 through the drain inlet 142.

In one embodiment, as shown in FIGS. 3–7, the inlet portion 120 is integrally formed as part of the housing 118. Alternatively, the inlet portion 120 may be a separate unit that is attached to the housing of the disposer. For example, the drain opening 142 may be extended downward to accommodate the water injection inlet 162, 262. Additionally, some of the existing mechanisms for connecting a disposer to a drain opening have elongated flexible tubular members. These are sometimes known as anti-vibration (AV) mounts. If the connecting mechanism has such an elongated member, the water injection inlet 162, 262 may be located on the connecting member. The secondary baffle could then be located between the inlet portion 120 and the disposer.

Figure 9:
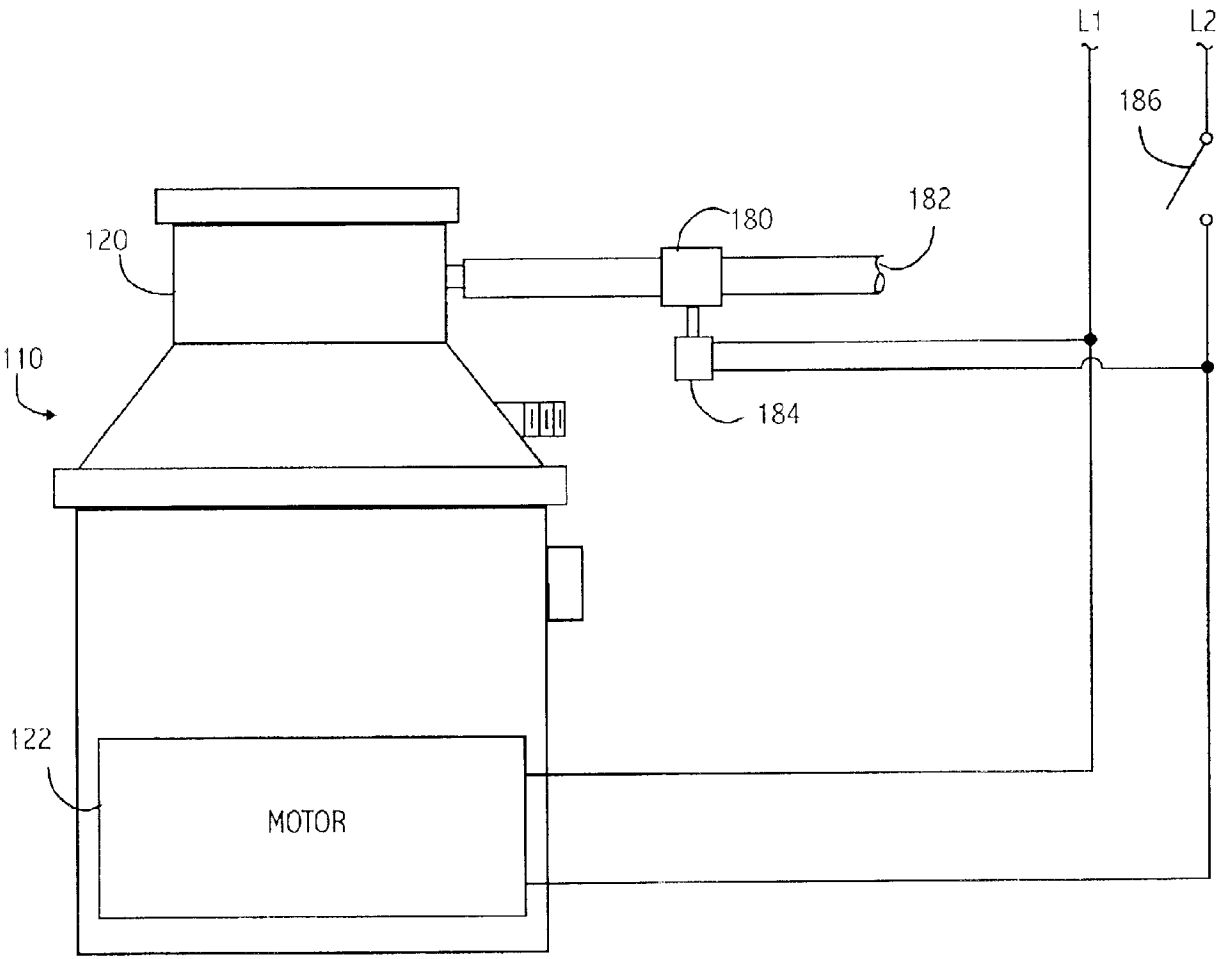
FIG. 9 is an illustration of one embodiment of electrical control circuitry.

Referring to FIG. 9, to control the flow of water through the water injection inlet 162, 262 a water valve 180 may be used. The water valve 180 would be connected between the water injection inlet 162, 262 and a line 182 pressurized water source. The water valve 180 may be opened and closed by use of an electrically controlled solenoid or actuator 184. As mentioned above, the motor 122 begins to rotate when a user activates a switch 186. The same switch 186 that activates the motor 122 may be used to activate the solenoid or actuator 184 that controls the water valve 180. In other words, when the motor 122 is connected to electric power source lines L1 and L2 with switch 186, the solenoid or actuator 184 is also connected to the power lines to open valve 180. Thus, every time the food waste disposer is turned on to carry out a grinding operation, the water valve 180 is opened so that water may enter the inlet portion 120 of the disposer 110 to create a water baffle 160, 260. Alternatively, the motor 122 and the water valve may be controlled by a controller. When the water valve is opened, water from a pressurized source is forced into the inlet portion 120. The injection of water creates a water baffle that extends substantially across the inlet portion 120 in a generally horizontal plane. When the motor switch is turned off, the water valve closes and inhibits water from entering the inlet portion 120.

The present invention also includes a method of operating a food waste disposer 110 to reduce noise. The food waste disposer 110 includes a motor section 114, a grinding section 116, and an inlet portion 120. The inlet portion 120 has a water injection inlet 162, 262. The inlet portion 120 may be integrally formed as part of the housing of the disposer 110 or may be a separate device attached to the housing of the disposer 110. In one embodiment, the method includes activating a motor 122 in the motor section 114 to provide rotational movement to a grinding mechanism in the grinding section 116. At the same time the motor 122 is activated, water is injected through the water injection inlet 162, 262 into the inlet portion 120 to create a water baffle 160, 260 inside the inlet portion 120. The injection of water in the inlet portion 120 continues until the motor 122 is deactivated.

What has been described is a food waste disposer having a mechanism and method for creating a water baffle to reduce noise. The water baffle allows food waste to pass through the drain opening 142, through the inlet portion 120, and into the grinding section 116. However, the water baffle reduces noise from dissipating from the motor section 114 and grinding section 116 through the drain opening 142. Accordingly, the food waste disposer runs quieter than conventional disposers.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A food waste disposer comprising:

an upper food conveying section including a housing to receive food waste;

a motor section including a motor to impart rotational movement to a motor shaft;

a central grinding section disposed between the food conveying section and the motor section, the food conveying section conveying food waste to the grinding section, the grinding section including a grinding plate; and an inlet portion having a water injection inlet, the water injection inlet including a nozzle capable of forming a water baffle that extends substantially across the inlet portion in a generally horizontal plane when the motor imparts rotational movement to the motor shaft.

2. The food waste disposer of claim 1, wherein the inlet portion is integrally formed as part of the housing of the food conveying section.

3. The food waster disposer of claim 1, wherein the inlet portion is separate but attached to the housing of the food conveying section.

4. The food waster disposer of claim 1, wherein the food waste disposer further includes a water valve connected between the water injection inlet and a pressurized water source.

5. The food waster disposer of claim 4, wherein the water valve is controlled by a solenoid or actuator.

6. The food waster disposer of claim 1, wherein the food waste disposer further includes a baffle made of a flexible material, the baffle in fluid communication with the water injection inlet.

7. A food waster disposer comprising:

a tubular food waste inlet portion;

a motor section including a motor to impart rotational movement to a motor shaft;

a central grinding section generally disposed between the tubular food waste inlet portion and the motor section, the tubular food waste inlet portion conveying food waste to the grinding section, the grinding section including a grinding plate; and a water injection inlet attached to the tubular food waste inlet portion and including a nozzle capable of forming a water baffle that extends substantially across the tubular food waste inlet portion in a generally horizontal plane, the water injection inlet in fluid communication with a water source when the motor imparts rotational movement to the motor shaft to form a water baffle in the tubular food waste inlet portion.

8. The food waster disposer of claim 7, wherein the tubular food waste inlet portion is integrally formed as part of a housing of the food waste disposer.

9. The food waster disposer of claim 7, wherein the tubular food waste inlet portion is separate but attached to a housing of the food waste disposer, the tubular food waste inlet portion made of a flexible material.

10. The food waster disposer of claim 7, wherein the food waste disposer further includes a water valve connected between the water injection inlet and the water source.

11. The food waster disposer of claim 10, wherein the water valve is controlled by a solenoid or actuator.

12. The food waster disposer of claim 7, wherein the food waste disposer further includes a baffle made of a flexible material, the baffle in fluid communication with the water injection inlet.

13. A method of reducing noise in a food waste disposer, the food waste disposer having a motor section, a grinding section, and an inlet portion, the inlet portion having a water injection inlet having a nozzle capable of creating a water baffle inside the inlet portion, the method comprising the steps of:

activating a motor in the motor section to provide rotational movement to a grinding mechanism in the grinding section; and injecting water through the water injection inlet to create a water baffle inside the inlet portion.

14. The method of claim 13, wherein the activating and injecting steps are performed simultaneously.

15. The method of claim 13, the water baffle extends substantially across the inlet portion in a generally horizontal plane.

16. The method of claim 13, wherein the water injection inlet has a nozzle.

17. The method of claim 13, wherein the food waste disposer further includes a baffle made of a flexible material, the baffle in fluid communication with the water injection inlet.

18. A food waste disposer comprising:

an upper food conveying section including a housing to receive food waste;

a motor section including a motor to impart rotational movement to a motor shaft;

a central grinding section disposed between the food conveying section and the motor section, the food conveying section conveying food waste to the grinding section, the grinding section including a grinding plate;

an inlet portion having a water injection inlet; and a baffle made of a flexible material, the baffle in fluid communication with the water injection inlet, the water injection inlet capable of forming a water baffle on the baffle when the motor imparts rotational movement to the motor shaft.

19. The food waste disposer of claim 18, wherein the inlet portion is integrally formed as part of the housing of the food conveying section.

20. The food disposer of claim 18, wherein the inlet portion is separate but attached to the housing of the food conveying section.

21. The food waster disposer of claim 18, wherein the food waste disposer further includes a water valve connected between the water injection inlet and a pressurized water source.

22. The food waster disposer of claim 21, wherein the water valve is controlled by a solenoid or actuator.

23. The food waster disposer of claim 18, wherein the water injection inlet includes a nozzle.

24. A method of reducing noise in a food waste disposer, the food waste disposer having a motor section, a grinding section, an inlet portion having a water injection inlet, and a baffle made of a flexible material, the baffle in fluid communication with the water injection inlet, the method comprising the steps of:

activating a motor in the motor section to provide rotational movement to a grinding mechanism in the grinding section; and injecting water through the water injection inlet to create a water baffle on the baffle.

25. The method of claim 24, wherein the activating and injecting steps are performed simultaneously.

26. The method of claim 24, wherein the water baffle extends substantially across the inlet portion in a generally horizontal plane.

27. The method of claim 24, wherein the water injection inlet has a nozzle.

* * * * *